US009100743B2

(12) United States Patent
Braho

(10) Patent No.: US 9,100,743 B2
(45) Date of Patent: Aug. 4, 2015

(54) METHOD AND SYSTEM FOR POWER DELIVERY TO A HEADSET

(71) Applicant: Vocollect, Inc., Pittsburgh, PA (US)

(72) Inventor: Keith Braho, Murrysville, PA (US)

(73) Assignee: Vocollect, Inc., Pittsburgh, PA (US)

( * ) Notice: Subject to any disclaimer, the term of this patent is extended or adjusted under 35 U.S.C. 154(b) by 316 days.

(21) Appl. No.: 13/835,699

(22) Filed: Mar. 15, 2013

(65) Prior Publication Data

US 2014/0270229 A1 Sep. 18, 2014

(51) Int. Cl.
*H04R 1/10* (2006.01)
*H04R 3/00* (2006.01)

(52) U.S. Cl.
CPC ..... *H04R 1/1025* (2013.01); *H04R 3/00* (2013.01); *H04R 2201/107* (2013.01); *H04R 2420/00* (2013.01)

(58) Field of Classification Search
CPC ..... H04R 1/10; H04R 1/1025; H04R 2225/31
USPC ..... 381/74, 15, 370, 309, 4
See application file for complete search history.

(56) References Cited

U.S. PATENT DOCUMENTS

| | | | |
|---|---|---|---|
| 3,781,492 | A | 12/1973 | Cragg et al. |
| 4,051,333 | A | 9/1977 | Schomburg |
| 4,414,433 | A | 11/1983 | Horie et al. |
| 4,727,578 | A | 2/1988 | Molnar |
| 4,737,735 | A | 4/1988 | Kampes |
| 4,782,524 | A | 11/1988 | McQuinn et al. |
| 4,821,329 | A | 4/1989 | Straub |
| 4,918,726 | A | 4/1990 | Snyder |
| 5,544,243 | A | 8/1996 | Papadopoulos |
| 5,625,684 | A | 4/1997 | Matouk et al. |
| 5,715,321 | A | 2/1998 | Andrea et al. |
| 5,732,143 | A | 3/1998 | Andrea et al. |
| 5,873,070 | A | 2/1999 | Bunte et al. |
| 5,978,689 | A | 11/1999 | Tuoriniemi et al. |
| 5,995,633 | A | 11/1999 | Cappels et al. |
| 6,020,788 | A | 2/2000 | Comeau |
| 6,126,465 | A | 10/2000 | Franks, Jr. |

(Continued)

FOREIGN PATENT DOCUMENTS

| | | | |
|---|---|---|---|
| DE | 202006004625 | U1 | 6/2006 |
| GB | 2359457 | A | 6/1925 |

(Continued)

OTHER PUBLICATIONS

European Search Report for Application No. 14158998.6, Dated Jun. 27, 2014, Total pp. 3.

(Continued)

*Primary Examiner* — Ahmad F Matar
*Assistant Examiner* — Sabrina Diaz
(74) *Attorney, Agent, or Firm* — Additon, Higgins & Pendleton, P.A.

(57) ABSTRACT

A power delivery method and system for powering a headset. A power signal is combined with an audio signal to form a composite signal that is communicated over a shared channel to the headset. The power signal is generated by modulating a carrier signal with a modulation signal. The modulation signal is derived from the amplitude of the audio signal so that the peak levels of the composite signal do not exceed the maximum allowable output of an audio I/O circuit driving the headset.

30 Claims, 7 Drawing Sheets

(56) References Cited

U.S. PATENT DOCUMENTS

| | | | |
|---|---|---|---|
| 6,128,384 | A | 10/2000 | Papadopoulos et al. |
| 6,748,095 | B1 | 6/2004 | Goss |
| 6,832,926 | B2 | 12/2004 | Rudolph et al. |
| 7,099,481 | B2 | 8/2006 | Baker et al. |
| 7,110,839 | B2 | 9/2006 | Wood |
| 7,305,253 | B2 | 12/2007 | Snyder et al. |
| 7,327,850 | B2 | 2/2008 | Crump et al. |
| 7,356,151 | B2 | 4/2008 | Seknicka |
| 7,408,109 | B1 | 8/2008 | Freitas |
| 7,450,726 | B2 | 11/2008 | Goyal |
| 7,464,029 | B2 | 12/2008 | Visser et al. |
| 7,492,914 | B2 | 2/2009 | Arvidsson |
| 7,627,352 | B2 | 12/2009 | Gauger, Jr. et al. |
| 7,734,361 | B2 | 6/2010 | Murawski et al. |
| 7,761,106 | B2 | 7/2010 | Konchitsky |
| 7,869,608 | B2 | 1/2011 | Sander et al. |
| 7,983,427 | B2 | 7/2011 | Yamkovoy et al. |
| 8,031,878 | B2 | 10/2011 | Gauger, Jr. et al. |
| 8,111,845 | B2 | 2/2012 | Braun |
| 2001/0053228 | A1 | 12/2001 | Jones |
| 2004/0254663 | A1 | 12/2004 | Dame |
| 2007/0104333 | A1 | 5/2007 | Kuo |
| 2007/0177741 | A1 | 8/2007 | Williamson |
| 2007/0281760 | A1 | 12/2007 | Nikitin et al. |
| 2008/0157998 | A1 | 7/2008 | Zuo et al. |
| 2008/0180874 | A1 | 7/2008 | Gauger et al. |
| 2010/0054493 | A1 | 3/2010 | Lin et al. |
| 2012/0321097 | A1 | 12/2012 | Braho |

FOREIGN PATENT DOCUMENTS

| | | |
|---|---|---|
| JP | 04503898 | 7/1992 |
| JP | 2006270583 | 10/2006 |
| KR | 2008007941 | 9/2008 |
| WO | 2007017810 A2 | 2/2007 |
| WO | 2007110807 A2 | 10/2007 |

OTHER PUBLICATIONS

European Office Action for Application No. 14158998.6, Dated Jul. 9, 2014, Total pp. 5.

Chinese Office Action with English Translation, Application No. 201420194121, Dated Jun. 11, 2014, Total pp. 3.

METHOD AND SYSTEM FOR POWER DELIVERY TO A HEADSET

FIELD OF THE INVENTION

The present invention relates generally to systems and methods for delivering power to a device and, more specifically, to systems and methods of multiplexing power and audio signals onto a shared conductor connecting a terminal device and a headset.

BACKGROUND OF THE INVENTION

Headsets are often employed for a variety of purposes, such as to provide bi-directional voice communications for human-to-human or human-machine interaction. These interactions can take place in a voice-directed or voice-assisted work environment, for example. Such environments often use speech recognition technology to facilitate work, allowing workers to keep their hands and eyes free to perform tasks while maintaining communication with a voice-directed portable computer device or larger system. A headset for such applications typically includes a microphone positioned to pick up the voice of the wearer, and one or more speakers—or earphones—positioned near the wearer's ears so that the wearer may hear audio associated with the headset usage. Headsets may be coupled to a mobile or portable communication device—or terminal—that provides a link with other mobile devices or a centralized system, allowing the user to maintain communications while they move about freely.

Headsets typically include a multi-conductor cable terminated by an audio plug, which allows the headset to be easily connected to and disconnected from the terminal by inserting or removing the audio plug from a matching audio socket. Standard audio plugs are typically comprised of a sectioned conductive cylinder, with each section electrically isolated from the other sections so that the plug provides multiple axially adjacent contacts. The end section is commonly referred to as a "tip", while the section farthest from the tip is referred to as a "sleeve". Additional sections located between the tip and the sleeve are known as "ring" sections. An audio plug having three contacts is commonly referred to as a TRS (Tip Ring Sleeve) plug or jack. Standard audio plugs are also commonly available with two contacts (Tip Sleeve, or TS) and four contacts (Tip Ring Ring Sleeve, or TRRS), although other numbers of contacts are sometimes used. Standard diameters for TRS type plugs include 6.35 mm, 3.5 mm, and 2.5 mm, and the connectors also typically have standard lengths and ring placements so that different headsets may be used interchangeably with a variety of terminals.

As communications systems have evolved, one trend has been to add active electronics to headsets to improve their performance and increase their functionality. Headsets today may include active noise reduction and signal enhancement circuits that process signals from multiple microphones, as well as other signal processing or conditioning circuits and devices, such as microphone biasing circuits and audio amplifiers. As more functionality is added to headsets, the associated electronic circuitry creates a need for power. One way of providing power to a headset is with a battery or similar power storage device located in the headset. However, batteries undesirably increase the size and weight of the headset, and must be regularly replaced or recharged, adding to the cost and maintenance burden of operating a powered headset. The cost and maintenance burdens are particularly undesirable in a work environment, since the headset may stop functioning unexpectedly when the battery exhausts its charge, potentially stopping work until a replacement battery or headset can be provided.

To avoid placing a battery in the headset, it has been proposed that power may be supplied to the headset from the terminal into which the headset is plugged. For example, additional conductors and connector contacts could be added to the terminal/headset interface to allow power to be directly sourced from the terminal. However, doing so would require changes in both headset and terminal hardware, and would create additional compatibility issues with standard multi-contact TRS type connectors. For this reason, headsets and terminals having the additional conductors might not be sufficiently compatible with older equipment to provide even original levels of functionality, thus increasing the total number of terminals and headsets which must be purchased, maintained, and tracked. In addition, as the number of separate conductors increases, the size and cost of cables and connectors also undesirably increase.

Another method that has been proposed to provide power to the headset is to allow power and audio signals to share a single conductor by multiplexing out of band power signals, such as a DC signal or high frequency carrier, with existing audio signals. One such method is described in U.S. Patent Application Pub. No. 2012/0321097, entitled "Headset Signal Multiplexing System and Method", filed on Jun. 14, 2011, the disclosure of which is incorporated herein by reference in its entirety. However, multiplexing power signals and audio signals onto the same conductor has other drawbacks. For example, such multiplexing increases the peak composite signal voltage levels, which can cause clipping and distortion in the limited amplitude channels characteristic of most terminal audio input/output circuits. Therefore, to allow audio and power signals to share the same limited amplitude channel, often either the power level of the baseband audio signal will need to be reduced, impacting the ability of the headset to provide sufficient audio volume to the wearer, or the amplitude of the carrier will need to be reduced, impacting the amount of power that can be delivered to the headset.

Yet another method that has been proposed to allow sharing of a limited amplitude channel that avoids the power sharing problems associated with audio and power signal multiplexing is to use a carrier signal employing constant envelope modulation, such as frequency modulation. In this type of system, power is provided to the headset by the constant envelope carrier, with the audio information modulating the carrier's frequency or phase. However, because the constant envelope carrier approach requires the audio signals to be recovered by an appropriate demodulation process on the receiving side, it is incompatible with existing headsets, and thus undesirable for at least all of the aforementioned reasons associated with methods requiring incompatible connectors.

Therefore, there is a need for improved methods and systems for providing power to headsets, and in particular, for coupling power from terminals to headsets over existing standard connector and cable interfaces in a way that is compatible with existing terminals and headsets.

BRIEF DESCRIPTION OF THE DRAWINGS

The accompanying drawings, which are incorporated in and constitute a part of this specification, illustrate embodiments of the invention and, together with a general description of the invention given below, serve to explain the principles of the invention.

SUMMARY OF THE INVENTION

Figure 1:
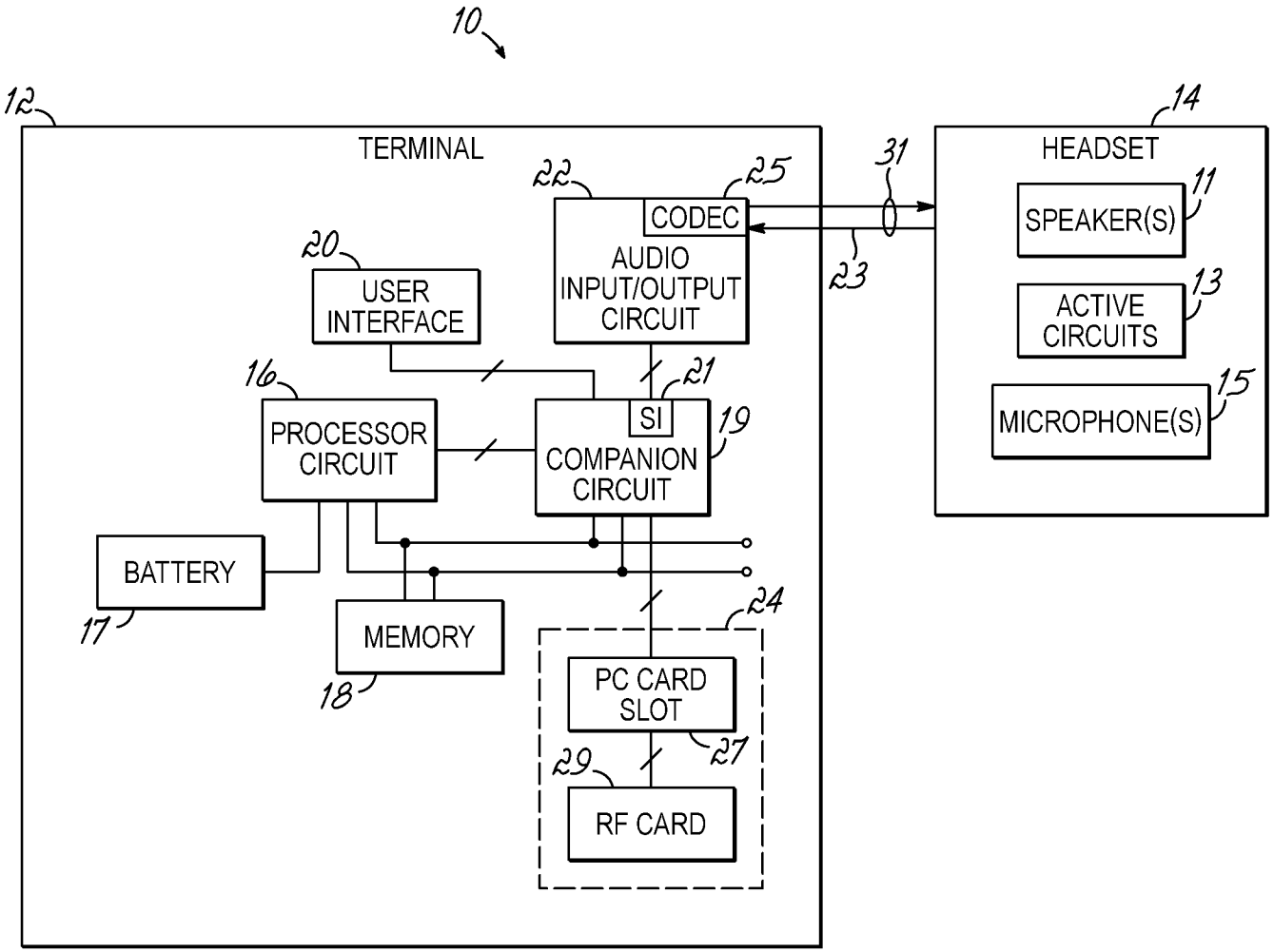
FIG. 1 is a block diagram illustrating an exemplary terminal and headset for implementing the invention.

In an embodiment of the invention, a method is provided for supplying power to a headset. The method includes, at a plurality of instances, processing an audio signal having a time-varying amplitude, generating a power signal by amplitude modulating a carrier signal with a modulation signal that is formed in a complementary fashion to the time-varying amplitude of the audio signal, and summing the power signal with the audio signal to form a composite signal having an amplitude limited to a maximum amplitude value.

In another embodiment of the invention, a system for providing power to a headset device with a cable is provided. The system includes an audio signal source configured to provide an audio signal having time-varying amplitude and a power signal source configured to generate a power signal by amplitude modulating a carrier signal with a modulation signal whose amplitude is formed in a complementary fashion to the time-varying amplitude of the audio signal. The system further includes a summing circuit operatively coupled to the audio signal source and the power signal source output and configured to output a composite signal having an amplitude limited to a maximum amplitude value.

In yet another embodiment of the invention, a communication system is provided. The communication system includes a terminal device and a headset device coupled to the terminal device with a cable. The terminal device includes an audio signal source configured to provide an audio signal having a time-varying amplitude, a power signal source configured to provide a power signal by amplitude modulating a carrier signal with a modulation signal whose amplitude is formed in a complementary fashion to the time-varying amplitude of the audio signal, and a summing circuit operatively coupled to the audio signal source and the power signal source output and configured to output a composite signal having an amplitude limited to a maximum amplitude value. The terminal device is further configured to provide the composite signal to the headset for playing the audio signal and powering the headset with the power signal.

DETAILED DESCRIPTION OF EMBODIMENTS OF THE INVENTION

Generally, the embodiments of the invention are directed to providing power from a terminal to a headset connected to the terminal over an audio channel in a way that preserves compatibility with existing and conventional terminals and non-powered headsets. To that end, a high frequency power signal is added to the audio output of the terminal to create a composite signal. The composite signal is then transmitted to the headset by the audio output circuit of the terminal. In the headset, the power signal is converted into a voltage suitable for powering electronic circuits so that the headset is powered remotely by the terminal. In accordance with an aspect of the invention, the power signal is generated by modulating a carrier signal with a signal derived from the audio signal, so that the amplitude of the power signal is inversely related to the amplitude of the audio signal. Thus, when the amplitude of the audio signal is high, the amplitude of the power signal is low, and vice versa. In this way, the peak amplitude of the composite signal is maintained within the capabilities of the terminal audio output circuit, while conveying as much power as possible without reducing the amplitude of the audio signal.

With reference to FIG. 1, a block diagram is presented illustrating a communications system 10 in accordance with an embodiment of the invention. System 10 includes a terminal device or terminal 12 coupled to a headset 14. The headset 14 may include one or more speakers 11, one or more active circuits 13, such as noise cancellation and/or other signal processing circuits, and one or more microphones 15. The headset 14 is coupled to the terminal by a cable 31, which may be a multi-conductor cable using a TRS connector or any other standard or non-standard audio connector. The headset 14 is worn by the system user and may, for example, allow hands-free operation and movement through a warehouse or other facility. Instructions or other audio signals may be played through the speakers 11 so that they are provided to the system user. Similarly, spoken data, questions, or commands by the user are picked up by at least one of the microphones 15 and conveyed to the terminal 12, so that the headset 14 provides an audio communications interface between the user and the terminal 12.

The terminal 12 may provide communication with a central computer system (not shown), such as an inventory management system, or any other system with which a worker might need to communicate. Terminal 12 includes a processor circuit or processor 16 for controlling the operation of the terminal 12, a system power source or battery 17, a memory 18, a companion circuit 19, a user interface 20, an audio input/output (I/O) circuit 22, and a network interface 24.

The processor 16 may be a microprocessor, micro-controller, digital signal processor (DSP), microcomputer, central processing unit, field programmable gate array, programmable logic device, or any other device suitable for manipulating signals based on operational instructions stored memory 18. As may be appreciated by a person of ordinary skill in the art, such processors often operate according to an operating system, which is a software-implemented series of instructions. The processor 16 may also run one or more application programs stored in the memory 18.

Memory 18 may be a single memory device or a plurality of memory devices including but not limited to read-only memory (ROM), random access memory (RAM), volatile memory, non-volatile memory, static random access memory (SRAM), dynamic random access memory (DRAM), flash memory, cache memory, and/or any other device capable of storing digital information. In an embodiment of the invention, the memory 18 may be integrated into the processor 16.

The optional companion circuit 19 provides input/output (I/O) management for the processor circuit 16, and is operatively coupled to the user interface 20, the audio I/O circuit 22, and the network interface 24. However, in an alternative embodiment of the invention, the I/O management functions provided by the companion circuit 19 may be integrated into the processor 16. In this alternative embodiment, the processor 16 may be coupled directly to the user interface 20, the audio I/O circuit 22, and the network interface 24.

The user interface 20 provides a mechanism by which a user may interact with the terminal 12 by accepting commands or other user input and transmitting the received input to the processor 16. The user interface 20 may include a keypad, touch screen, buttons, a dial or other method for entering data. In one embodiment, the processor 16 runs speech recognition applications and text-to-speech (TTS) applications for use with the terminal 12 and headset 14 in voice-directed or voice-assisted work environments. The user interface 20 may also include one or more displays to communicate information to the user. The user interface 20 may also communicate to the user though voice reproductions or synthesis, audio tones, or other audible signals transmitted through the processor 16 and audio I/O circuit 22 to the headset 14, where they may be heard by the user.

The audio I/O circuit 22 is coupled through an appropriate interface 21 to the companion circuit 19 or the processor 16, as the case may be. For example, in the embodiment illustrated in FIG. 1, the audio I/O circuit 22 is coupled through serial interface 21 to the companion circuit 19. The audio I/O circuit 22 provides an interface between the processor 16 and the headset 14 that enables the terminal 12 to receive audio signals from, and transmit audio signals to, the headset 14. The audio I/O circuit 22 includes a codec 25 for conversion between digital and analog audio signals, and is configured to receive one or more audio signals 23 from the headset 14. The audio I/O circuit 22 converts the one or more received audio signals—which may be analog electrical signals produced by the microphones 15—into a digital signal suitable for manipulation by the processor 16. The audio I/O circuit 22 also converts the digital output signals provided by the processor 16 into a form suitable for driving the headset speakers 11. In addition to the codec 25, the audio I/O circuit 22 may include amplification stages in order to provide a signal having sufficient voltage and current levels to provide suitable audio output levels at the speakers 11. Although shown as a separate block in FIG. 1, some or all of the functions of the audio I/O circuit 22, particularly those associated with analog to digital and/or digital to analog signal conversion, may be integrated into another component such as the processor 16.

To provide wireless communication between the terminal 12 and the central computer system, the terminal 12 may include a network interface 24. The network interface 24 may include a PC card slot 27 configured to accept a radio frequency (RF) card 29 so as to provide a wireless network connection, such as an IEEE 802.11 (Wi-Fi) wireless standard connection. RF communication cards 29 from various vendors might be coupled with the PCMCIA slot 27 to provide communication between terminal 12 and the central computer system. The network interface 24 may also include a self contained wireless transceiver, so that an RF communication card 29 is not required. In addition to the aforementioned Wi-Fi standard, the network interface 24 may also provide a wireless link to a local network using any other suitable wireless networking technology, such as IEEE 802.15.1 (Bluetooth), and/or IEEE 802.15.4 (including ZigBee, WirelessHART, and MiWi). One suitable terminal device which may be used to implement the invention is an MC9090 Handheld Mobile Computer from Motorola of Schaumburg, Ill. Other suitable terminal devices may include, but are not limited to: mobile phones, personal music players, personal computers such as laptops or tablet PC's, and/or an aircraft audio system.

Figure 2:
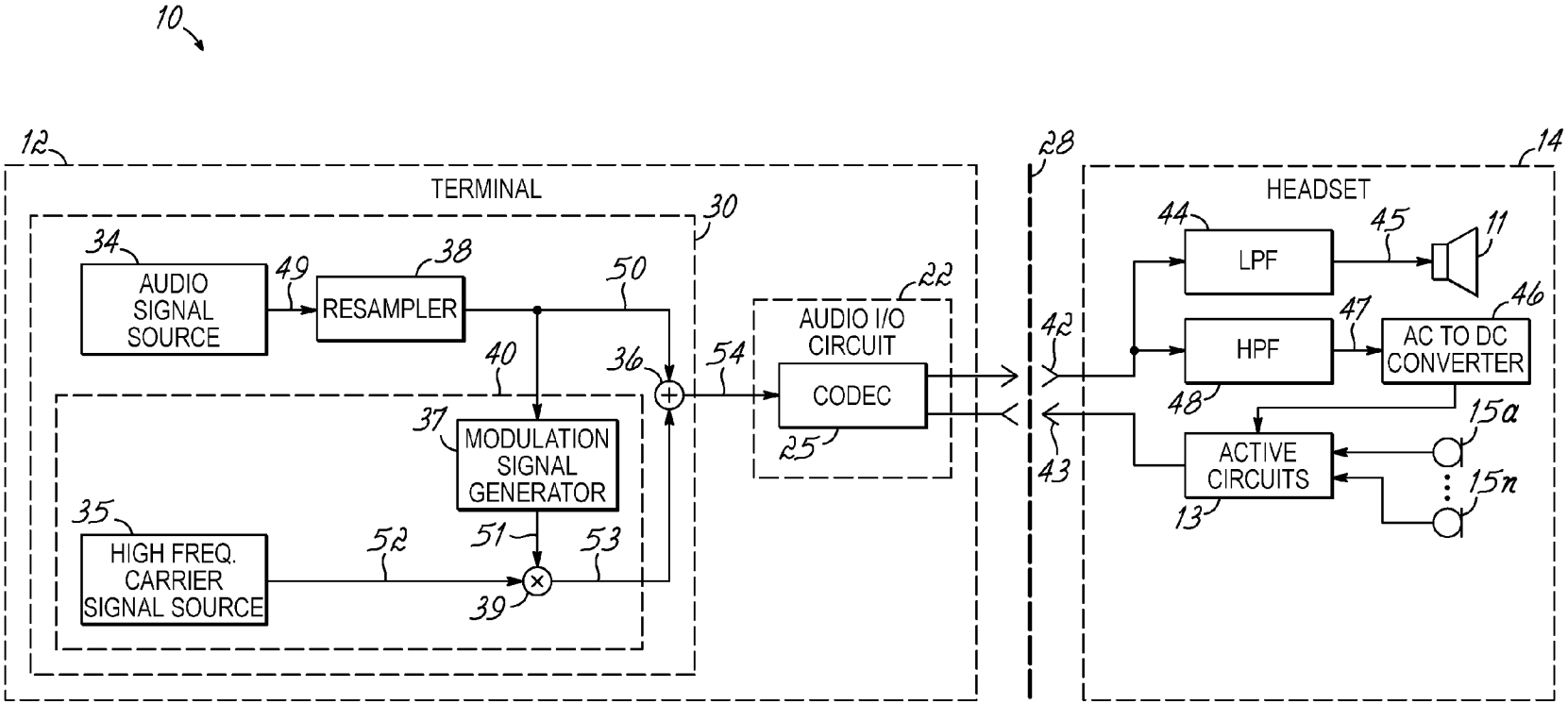
FIG. 2 is a block diagram showing an exemplary terminal and headset in more detail in accordance with an embodiment of the invention.

With reference to FIG. 2, a block diagram is presented illustrating select components and circuits of the terminal 12 and headset 14 in accordance with embodiments of the invention. The terminal 12 and headset 14 are coupled over a headset-terminal interface 28. The headset-terminal interface 28 may be a multi-contact plug and socket connection including a tip and a sleeve, and may also include one or more rings. As will be described in more detail below, the amplitude modulated power supply system provides a mechanism by which power may be provided to the headset 14 from the terminal 12 over the headset-terminal interface 28 without distorting or reducing the amplitude of audio signals sharing the interface 28.

Terminal 12 includes suitable signal processing and synthesis circuitry 30 for providing an audio signal and power signal combination for implementing the invention. The synthesis circuitry 30 and its functionality may be implemented completely or partially within the processing circuit 16 of the terminal 12, or may be implemented as separate circuit components. The composite signal 54 is provided to the audio I/O circuit 22 by the synthesis circuitry 30. The codec 25 of audio circuit 22 converts digital signals provided by synthesis circuitry 30 into analog signals suitable for operation of the headset 14. The codec 25 may also convert analog signals received from headset 14 into digital signals suitable for processing by the processor 16.

In the illustrated embodiment, the synthesis circuitry 30 includes an audio signal source 34, a high frequency carrier signal source 35, a summing circuit 36, modulation signal generator 37, a resampler circuit 38, and an amplitude modulator 39. These synthesis circuit functions may be realized in hardware, by device driver level software, and/or in application level software running on the processor circuit 16. Advantageously, because the synthesis circuitry 30 may be implemented by modifying the terminal software, embodiments of the invention may be implemented without hardware changes on the terminal side. Embodiments of the invention may thereby allow the use of existing terminal hardware by simply updating the terminal software, thus avoiding costly changes to the terminal hardware and/or audio connectors.

Embodiments of the invention may be implemented in the audio device driver software, the application level software, or in some other software component or layer. The software modules in which embodiments of the invention are implemented may depend on which modules are most easily modified, or based on the accessibility of the various software modules. For example, a hardware manufacturer may prefer to implement the invention in device driver software, thereby alleviating the need for application developers to incorporate the functionality into their application. On the other hand, if a hardware device or device driver does not support an embodiment of the invention, an application developer may implement the embodiment in the application level software. Embodiments of the invention are therefore not limited to modification of a specific software or hardware module.

Headset 14 includes the one or more speakers 11 electrically coupled to a headset input 42, and an AC to DC converter 46 electrically coupled to input 42. In the exemplary embodiment illustrated in FIG. 2, input 42 is coupled to the AC to DC converter 46 by a high pass filter 48. The speakers 11 may be coupled to the headset input 42 by a low pass filter 44 as illustrated, or—depending on the frequency content of the power signal and the frequency response of the speakers 11—the low pass filter 44 may be omitted. In the embodiment shown in FIG. 2, the active circuit 13 is electrically coupled to the converter 46, a headset output 43, and a plurality of microphones 15*a*-15*n*. The active circuit 13 receives power from the converter 46, and combines the microphone signals so that they may be transmitted to the terminal 12 over the interface 28. Active circuit 13 may include noise cancellation circuits, beam forming circuits, multiplexing circuits, and/or any other type of suitable signal processing circuit. Alternative embodiments of the invention may use the output of the converter 46 to power an active circuit connected to the speaker 11 (connections not shown) for amplification of the audio signal, noise cancellation, sound shaping, Dolby™ processing, or other forms of equalizations and sound effects.

Audio that is to be transmitted to the headset 14 to be played through speakers 11 is provided to or generated by the audio signal source 34, which provides an appropriate raw audio signal (u[n]) 49 to be transmitted to the headset 14. The raw audio signal 49 provided by the audio signal source 34 may be reflective of audio signals originating from text-to-speech (TTS) synthesis functions of the terminal 12, audio files stored in memory 18, audio received from a communications system to which the terminal 12 is operatively connected, and/or any other audio signals to be communicated to the headset wearer. Such audio signals will generally have a time-varying amplitude, which is the absolute value of the signal level.

In an embodiment of the invention, the signals in the synthesis circuitry 30 are digital signals. To accommodate a raw audio signal 49 that has a different sampling rate than that of the high frequency carrier signal source 35, the raw audio signal 49 may be coupled through the resampler 38. The resampler 38 may output an audio signal (x[n]) 50 having a sampling rate that is compatible with a carrier signal (c[n]) 52 generated by the high frequency carrier signal source 35.

The high frequency carrier signal source 35, modulation signal generator 37, and amplitude modulator 39 may collectively form a power signal circuit 40 that generates a high frequency power signal (y[n]) 53. To this end, the high frequency carrier signal source 35 provides a carrier signal (c[n]) 52 that is coupled to the amplitude modulator 39. The modulation signal generator 37 generates or forms a modulation signal (m[n]) 51 based on the audio signal 50, and specifically in a complementary fashion to the time varying amplitude of the audio signal, as will be described in more detail below. The modulation signal 51 is coupled to the amplitude modulator 39, which generates the power signal 53 by modulating the carrier signal 52 with the modulation signal 51. The power signal 53 is then combined with the audio signal 50 by the summing circuit 36 to generate a composite signal (z[n]) 54, which is directed to the headset 14 in accordance with embodiments of the invention. The audio signal 50 and power signal 53 are summed or added by appropriate circuit, such as the summing circuit 36 to form a composite signal (z[n]) 54. The composite signal 54 is then converted into an analog signal by the digital-to-analog functionality of the codec 25 and provided to the headset 14 over the headset-terminal interface 28.

The carrier signal 52 may be any bandwidth-limited, sampled signal from a continuous periodic waveform, such as a square wave, triangle wave, pulse train, or sinusoidal wave. In a preferred embodiment, the carrier signal 52 is a sinusoidal wave at a frequency 40% to 50% (inclusive) of the sampling frequency of the codec. At a frequency of 50% of the sampling frequency of the codec, the carrier signal 52 can be constructed by simply alternating samples of 1's and −1's. Although this may be the simplest way to generate the carrier signal 52, the amplitude response of a DAC typically rolls off near this frequency. Consequently, selecting a carrier frequency lower than 50% of the sampling frequency of the codec may be more advantageous in terms of the generated output power. It may also be advantageous for the sampling frequency of these digital signals to be at the maximum sampling frequency of the codec 25 in order to maximize the frequency separation (or minimize the adverse effects of any frequency overlap) between the audio signal 50 and the power signal 53.

When used in environments having a high ambient noise level, such as those found in many workplaces, headset users often use the loudest audio output signal level setting (maximum volume) available in order to reliably hear the audio over the ambient noise. When the terminal 12 is set to output maximum audio volume, the peak amplitude of the audio signal 50 will typically be at a level that causes peak output voltages that are at or close to the maximum possible output voltage range of the codec 25. This may leave insufficient voltage headroom to add an adequate constant amplitude power signal to the audio signal without the codec 25 clipping the composite digital signal 54 or analog signal 42. This may result in distortion and/or a reduction in the amplitude of the audio signal 50, as well as insufficient power transfer between the terminal 12 and the headset 14. However, by applying a technique referred to herein as "complementary amplitude modulation" to the carrier signal 52, embodiments of the invention enable the high frequency power signal 53 to transfer power to the headset 14 without clipping the composite signal 54, or otherwise distorting or reducing the amplitude of the recovered audio signal 50.

Figure 3A:
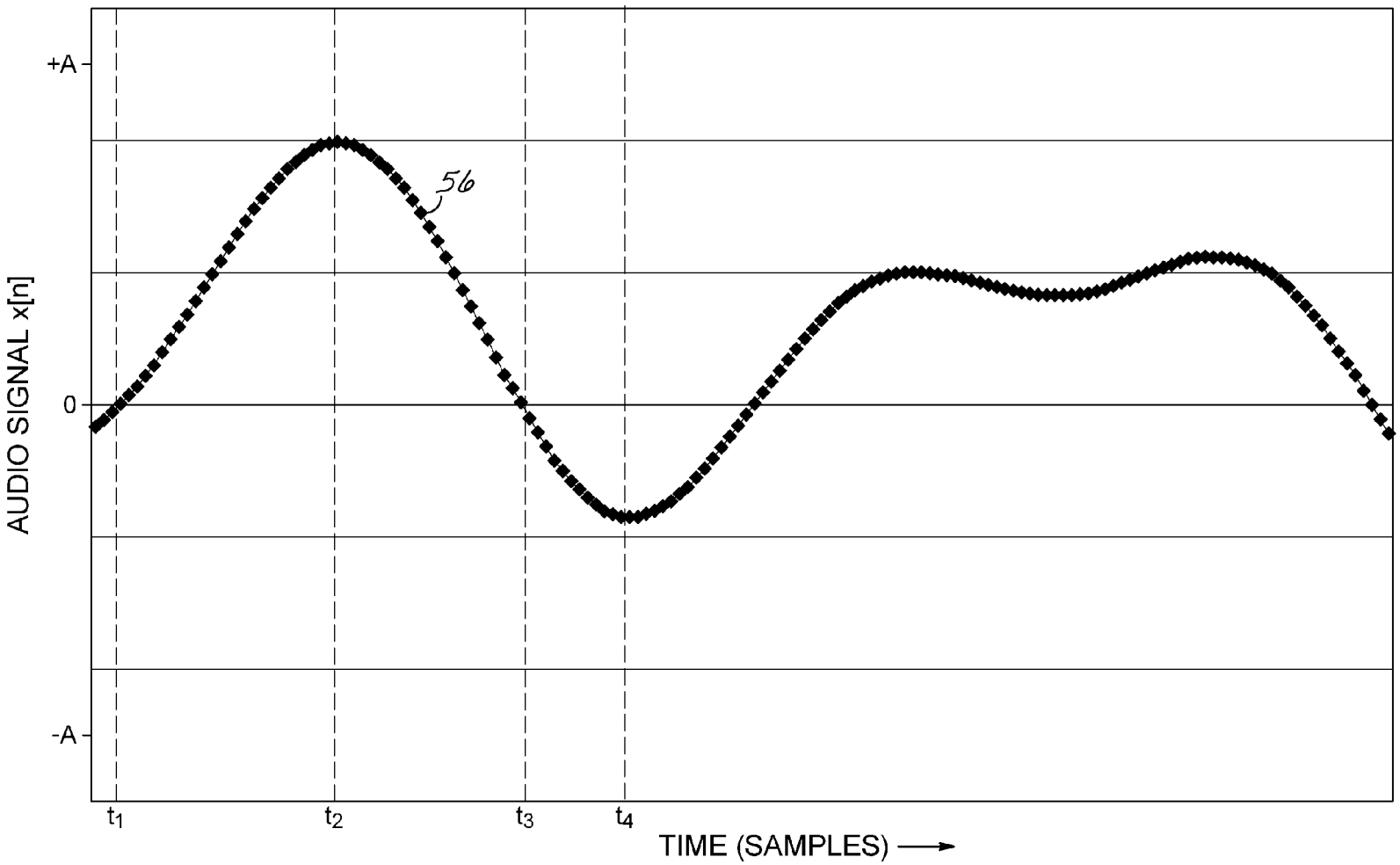
FIG. 3A is a graph illustrating an exemplary waveform representing an audio signal in accordance with an embodiment of the invention.
Figure 3B:
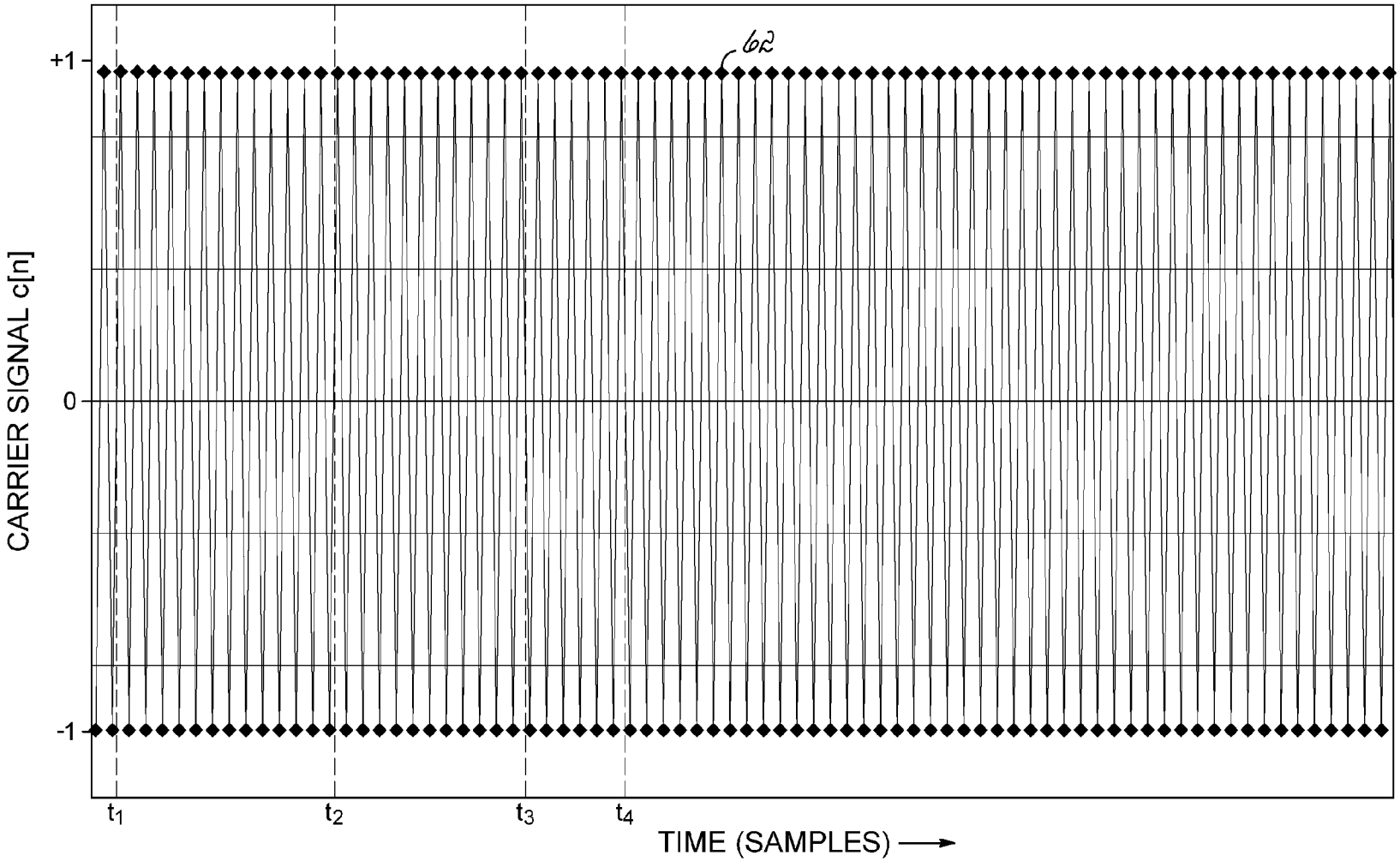
FIG. 3B is a graph illustrating an exemplary waveform representing a carrier signal in accordance with an embodiment of the invention.
Figure 3C:
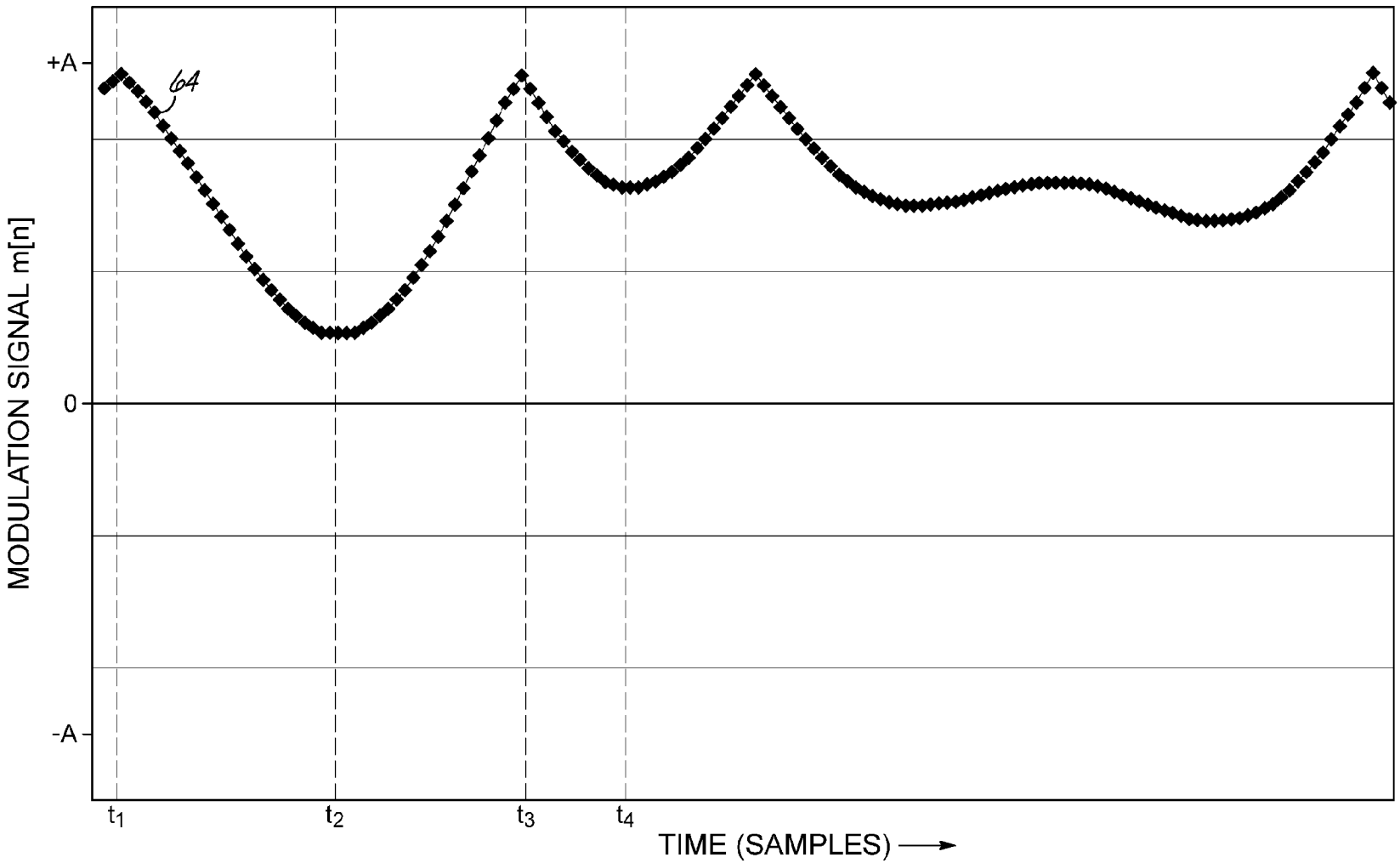
FIG. 3C is a graph illustrating an exemplary waveform representing a modulation signal in accordance with an embodiment of the invention.
Figure 3D:
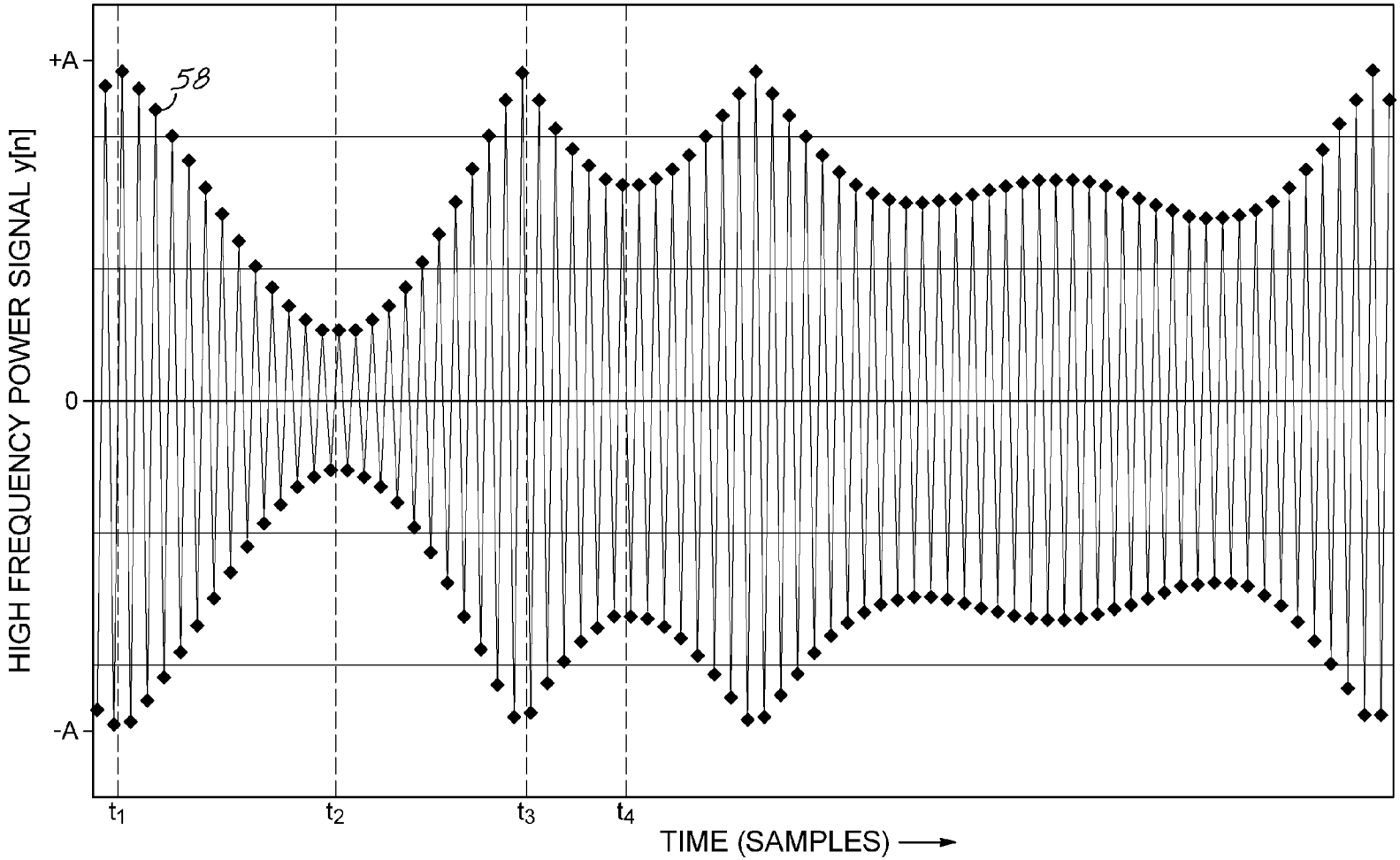
FIG. 3D is a graph illustrating an exemplary waveform representing a high frequency power signal in accordance with an embodiment of the invention.
Figure 3E:
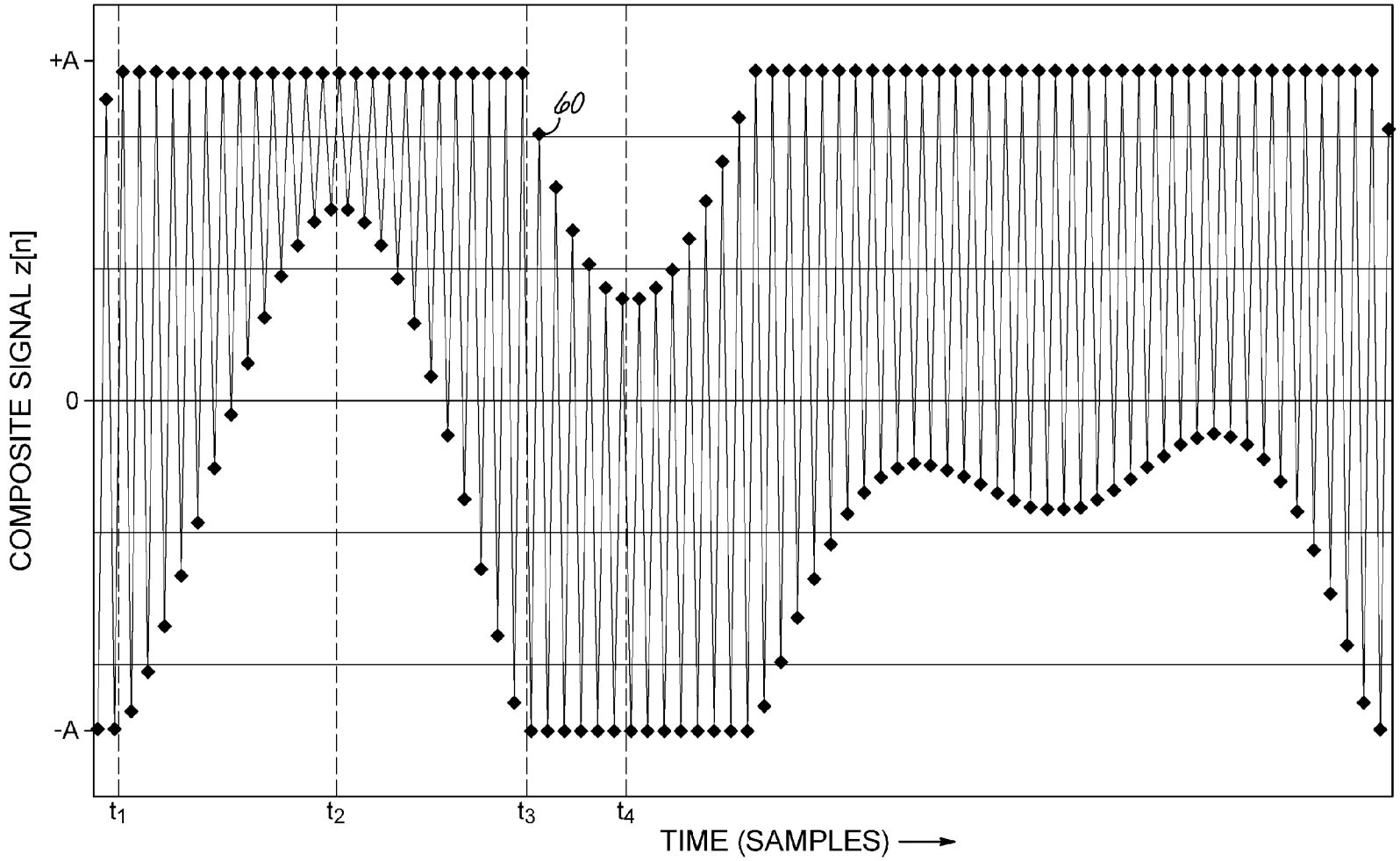
FIG. 3E is a graph illustrating an exemplary waveform representing a composite signal in accordance with an embodiment of the invention.

With reference to FIGS. 3A-3E, and in accordance with an embodiment of the invention, exemplary graphical representations are presented of an audio signal x[n] (represented by the sampled audio signal waveform 56 in FIG. 3A), a carrier signal c[n] (represented by the sampled carrier signal waveform 62 in FIG. 3B), a modulation signal m[n] (represented by the sampled modulation signal waveform 64 in FIG. 3C), a high frequency power signal y[n] (represented by the sampled high frequency power signal waveform 58 in FIG. 3D), and a composite signal z[n] (represented by the sampled composite signal waveform 60 in FIG. 3E). These graphical representations are presented for the purpose of demonstrating the operation of the amplitude modulated power signal system in accordance with an embodiment of the invention. As such, the following discussion of the interaction between the audio signal x[n], the power signal y[n], the composite signal z[n], the carrier signal c[n], and the modulation signal m[n] will refer to their respective exemplary waveform representations 56, 58, 60, 62, 64.

Referring now to FIG. 3A, the audio signal waveform 56 includes frequency content that falls within the range of normal human hearing, such as that produced by speech. The audio signal has a time-varying amplitude. For systems that primarily deliver audio containing human speech, the audio signal waveform 56 may have a maximum frequency content of about 8 kHz, although the invention is not so limited. The audio signal x[n] represented by waveform 56 may be an analog or digital signal that is within the output range of −A to +A, where A is a value chosen based on power delivery requirements such that A is less than or equal to the largest instantaneous amplitude that the audio I/O circuit 22 can produce. Thus, A may represent the peak AC voltage for the audio I/O circuit 22, and/or a maximum possible signal value for the audio signal x[n] or audio signal waveform 56. By way of example, for a terminal 12 employing an audio I/O circuit maximum output voltage range of ±2.5 volts, +A might represent a voltage of 2.5 volts, while −A might represent a voltage of −2.5 volts. Thus, in the above example, the output of the audio I/O circuit 22 may vary around an equilibrium value of 0 volts. Note that digital systems often have an even number of discrete values, so the range of the resulting signal may be asymmetric around the equilibrium, since after accounting for the equilibrium value, the number of discrete values to distribute above and below equilibrium is an odd number. By way of example, for a terminal 12 employing an 8 bit audio codec with input range −128 to 127 and equilibrium value of 0, A might be chosen to be 127, so that +A represents a digital value of +127 a while −A represents a digital value of −127. However, in this case, if the signal uses the full range of −128 to 127, A may alternatively be chosen to be 127.5 (half the range). This will produce an offset of 0.5 ND steps between the equilibrium values with and without the power signal y[n] added. However, this half step can generally be ignored when the number of steps is sufficiently high.

In accordance with an embodiment of the invention, the composite signal waveform 60 is generated by adding the power signal waveform 58 to the audio signal waveform 56. To prevent instantaneous values of the composite signal waveform 60 delivered to the codec 25—and thus to the headset 14—from exceeding +A or falling below −A, the amplitude of the power signal waveform 58 is controlled based on the amplitude of the audio signal waveform 56. This may be accomplished by generating the power signal 58 waveform by amplitude modulating the carrier signal waveform 62 with a modulation signal 64 that is formed or derived from the time-varying amplitude (absolute value of the signal level) of the audio signal waveform 56. To this end, the power signal waveform 58 is generated by amplitude modulating the carrier signal 62 shown in FIG. 3B with the modulation signal waveform 64 shown in FIG. 3C, which has an amplitude that varies inversely to the amplitude of the audio signal waveform 56. The carrier c[n] may be a continuous or sampled square wave, triangle wave, sinusoidal function, or any other suitable carrier waveform. The resulting modulation signal m[n] is a time varying signal that has an amplitude value equal to the difference between +A and the absolute value of the amplitude of the audio signal x[n]. Modulation signal m[n] is thus given by the equation:

$$m[n]=A-\mathrm{abs}(x[n])$$

where A is a value chosen based on hardware considerations such that A is less than or equal to the largest instantaneous amplitude that the audio I/O circuit 22 can produce. For example, A may equal the maximum output value that the codec 25 of the audio I/O circuit 22 can deliver. The absolute value function abs(x[n]) returns the absolute value of its argument x[n].

The value of A may be adjusted depending on the power supply voltage requirements in the headset or other hardware considerations, but is preferably greater than or equal to the maximum amplitude of x[n]. The high frequency power signal waveform y[n] to be added to the audio signal waveform x[n] is provided by using the modulation signal m[n] to modulate the carrier signal c[n]. As noted above, the carrier signal c[n] may be a bandwidth limited square wave, pulse train or sinusoidal wave at the selected carrier frequency. The power signal y[n] is given by the equation:

$$y[n]=m[n]\times c[n]$$

where c[n] is the sampled carrier waveform value at time [n] and for simplicity is assumed here to range from −1 to +1. The peak-to-peak amplitude of the power signal y[n] thus varies over time in complementary fashion to the time-varying amplitude of the audio signal x[n]. Referring to the exemplary plots 56, 58, 60 depicted in FIGS. 3A, 3D and 3E, to form the composite signal z[n] that is provided to the headset 14, the high frequency power signal y[n] is added to the audio output signal x[n]. The composite signal z[n] is thus given by the equation:

$$z[n]=x[n]+y[n]$$

Advantageously, by taking the absolute value of the audio signal x[n] and using it to continuously adjust the amplitude of the power signal y[n], the amount of power delivered to the headset may be maximized: (1) within the voltage output constraints imposed by the codec 25 and audio I/O circuit 22; and (2) without negatively impacting the audio signal delivered to the headset 14.

With continued reference to FIGS. 3A-3E, and by way of example, as the amplitude of the audio signal x[n] increases above the equilibrium value (e.g., 0), as illustrated by the upward movement in exemplary waveform 56 from time $t_1$ to time $t_2$, the value of the modulation signal m[n] decreases, as illustrated by the downward movement of waveform 64. In response, the amplitude of the power signal y[n] is correspondingly reduced, as represented by exemplary waveform 58. Near time $t_2$, the audio signal waveform 56 reaches a local maximum. This maximum amplitude of the audio signal waveform 56 is reflected by a correspondingly reduced amplitude of the power signal waveform 58, which reaches a local minimum.

In a corresponding manner, as the amplitude of the audio signal x[n] decreases toward equilibrium, such as represented by waveform 56 from time $t_2$ to $t_3$, the value of modulation signal m[n] (as represented by the upward movement of exemplary waveform 64) increases. This increase in m[n] results in the amplitude of power signal y[n] also increasing, as represented by the increase in amplitude of the exemplary power signal waveform 58. The power signal waveform 58 reaches a local maximum at approximately time $t_3$, when the audio signal waveform 56 amplitude is at or near equilibrium. When the audio signal waveform 56 amplitude is near equilibrium, such as shown at time $t_3$, the amplitude of y[n], as represented by the exemplary power signal waveform 58, is near its maximum. Therefore, as shown in FIG. 3E, the composite signal waveform 60 has a peak-to-peak amplitude of about 2×A whenever the audio signal x[n] is near equilibrium.

As illustrated by waveform 56 from time $t_3$ to time $t_4$, when the amplitude of audio signal x[n] begins to fall below the audio output signal range equilibrium value, the absolute value or magnitude of audio signal waveform 56 begins to increase. As such, y[n], as represented by exemplary power signal waveform 58, needs to adjust accordingly. In a similar manner as previously described with respect to the increasing audio output amplitude between times $t_1$ to $t_2$, the increasing amplitude of the audio signal waveform 56 causes the amplitude of the power signal waveform 58 to be reduced between times $t_3$ and $t_4$. In this way, the negative peak values of composite signal z[n], as represented by composite signal waveform 60, do not extend below −A, as depicted in FIG. 3E.

Advantageously, in an embodiment of the invention, the composite signal z[n] may be generated in application layer software running on the processor 16, thus avoiding changes to existing terminal or headset-terminal interface hardware or drivers. In an alternative embodiment of the invention, the power signal y[n] may be added to the audio signal x[n] below the application layer, such as in an audio driver, obviating the need for the application layer software to modify the signal. In either case, depending on the sample rate of the audio files or streams used to supply the audio signal source 34, the synthesis circuitry 30 may be required to convert the sample rate of the audio file or signal to a higher or lower rate in order to match the sample rate of the high frequency power signal y[n].

The absolute value operation used in forming the modulation signal m[n] is nonlinear, and therefore introduces higher order harmonics. When modulated, these higher harmonics may overlap with the audio signal x[n] in the frequency domain, making it harder to separate the power signal y[n] and the audio signal x[n] in the headset. This overlap may also introduce distortions in the audio signal played through the speakers in the headset. Consequently, a carrier frequency should be selected that is high enough to create a separation in frequency between the high frequency power signal y[n] and the audio signal x[n]. Because the carrier signal c[n] is amplitude modulated by a modulation signal m[n] that includes the audio signal x[n] (ignoring aliasing and the harmonics mentioned above), the power signal y[n] will have a bandwidth twice as wide as the bandwidth of the audio signal x[n]. For example, for an audio signal x[n] having a bandwidth of 8 kHz, the power signal y[n] will have a bandwidth of 16 kHz centered about the frequency of the carrier signal c[n]. Therefore, the highest frequency present in the power signal y[n] will be equal to $f_c+f_a$, where $f_c$ equals the frequency of the carrier c[n] and $f_a$ equals the highest frequency present in the audio output signal x[n]. For a power signal y[n] that is created digitally, the sample rate would thus need to be $\geq 2\times(f_c+f_a)$ in order to prevent aliasing. However, it has been determined that because aliasing does not negatively affect either the functioning of the headset's power circuit 46, 48, or the quality of an extracted audio signal 45 received in the headset 14, it is permissible to allow the upper sideband of the power signal y[n] to be aliased.

Therefore, a sample frequency equal to two times the frequency of the carrier signal c[n] may be used. Advantageously, this allows the use of reduced sample rates as compared to a system requiring an unaliased high frequency power signal y[n]. More advantageously, using a sample rate that is twice the frequency of the carrier signal c[n] allows the carrier signal c[n] to be generated by simply generating a sequence of alternating polarity values at the sample rate frequency, reducing the computational load on the processor 16. However, it is not uncommon for implementations of audio I/O circuit 22 to attenuate frequency content at or near a frequency of half of the sample rate, which may reduce the power delivery capability of the system. Thus, using a carrier signal frequency of between 40% and 50% of the sample rate may be more advantageous, depending on the constraints and requirements for power delivery and sample rate.

Referring again to FIG. 2, and by way of example, for a system 10 operating with an audio signal 50 having an upper frequency of 8 kHz, and a headset 14 that filters out audio frequencies above 8 kHz, a carrier signal with frequency 24 kHz could be used to produce the high frequency power signal 53 without the lower sideband of the power signal 53 overlapping the audio signal 50. Because the sample rate only needs to be twice the base carrier frequency, the above described frequency scheme could be implemented using a 48 kHz sample rate, which is a commonly supported sample rate in audio codecs. Advantageously, allowing aliasing of the power output signal thereby reduces the codec bandwidth and sample rate requirements, which may allow the use of lower cost and lower power codecs.

In operation, the composite signal 54 is transmitted to the headset input 42 over the headset-terminal interface 28. Headset-terminal interface 28 may be in the form of any appropriate physical interface, such as in the form of a standard TRS type interconnection. In the headset 14, the audio signal 50 is extracted from the composite signal 54 by a low pass filter 44 to create the extracted audio signal 45, which is coupled to the speaker 11. By filtering the composite signal 54, the audio signal 50 is reproduced by the speaker 11 without interference from the power signal 53, and the power signal 53 is prevented from being dissipated in the speaker 11. Alternatively, the speaker 11 may present sufficiently high impedance to the power signal 53, as well as have a sufficient high frequency roll off response, so that the low pass filter 44 is unnecessary. Advantageously, this aspect of the invention may allow headsets that do not make use of the power signal 53 to function with terminals outputting the composite signal 54 that contains the power signal 53. Therefore, older headsets may remain compatible with terminals 12 that embody the inventive power feature without the need to detect the type of headset used, or to disable the inventive power feature in the terminal 12.

To provide power to the headset 14, the composite signal 54 is passed through a high pass filter 48 to create an extracted high frequency power signal 47, which is coupled to an AC to DC converter 46. The high pass filter 48 presents sufficiently high impedance to the audio output signal 50 portion of the composite signal 54 so as to prevent the AC to DC converter 46 from significantly loading down the audio output signal 50 portion of the composite signal 54. The AC to DC converter 46 may include a diode ring forming a bridge rectifier, or other circuit capable of converting the extracted high frequency power signal 47 into a voltage having a DC component. The AC to DC converter 46 may also include a boost converter (not shown) to increase the voltage output, so that the AC to DC converter 46 provides an output voltage at a level sufficient to power active hardware circuits 13 in the headset 14. To this end, the output of the converter circuit 46 is coupled as a power signal to the active headset circuits. For example, the active headset circuits might include noise cancellation hardware circuits or processors running noise cancellation software. The converter output might also be used to power or bias one or more microphones or other active hardware circuits such as those mentioned above.

Embodiments of the headset power delivery system thus transmit power from terminals to headsets over existing headset-terminal interfaces without modification to connectors or cables. Compatibility with existing headsets is further improved because the power is transmitted largely or completely out of the audio band, so that the power signal may be inaudible in non-powered headsets. Because the system allows the use of substantially all of the power available at the output of the terminal audio circuit while preserving the audio signal level, power is transferred more efficiently between the terminal and headset than in systems that add a fixed level power output signal. Further, the use of a base carrier signal with a frequency at half the codec sample rate eliminates the need for trigonometric calculations and simplifies power output signal generation, reducing the computational load on the terminal processor. Furthermore, no batteries are necessary in the headset in a headset/terminal system using the invention.

While the invention has been illustrated by a description of various embodiments, and while these embodiments have been described in considerable detail, it is not the intention of the applicant to restrict or in any way limit the scope of the appended claims to such detail. Additional advantages and modifications will readily appear to those skilled in the art. For example, a band pass filter can be used in place of any high pass or low pass filter as described in this document. The invention in its broader aspects is therefore not limited to the specific details, representative methods, and illustrative examples shown and described. Accordingly, departures may be made from such details without departing from the spirit or scope of applicant's general inventive concept.

What is claimed is:

1. A method of providing power to a headset, the method comprising:

processing an audio signal having a time-varying amplitude;

generating a power signal by amplitude modulating a carrier signal with a modulation signal that is formed in a complementary fashion to the time-varying amplitude of the audio signal; and summing the power signal with the audio signal to form a composite signal having an amplitude limited to a maximum amplitude value.

2. The method of claim 1 wherein the modulation signal is formed by subtracting, from the maximum amplitude value, a value that is reflective of the amplitude of the audio signal.

3. The method of claim 1 wherein the modulation signal is formed by subtracting, from the maximum amplitude value, a value that is reflective of the absolute value of the amplitude of the audio signal.

4. The method of claim 1 wherein the carrier signal is a bandwidth-limited periodic signal.

5. The method of claim 4 wherein the periodic signal is selected from the group consisting of a square wave signal, a pulse train signal, a triangle wave signal, and a sinusoidal signal.

6. The method of claim 1 wherein the power signal and audio signal are digital signals having a sampling rate.

7. The method of claim 6 wherein the power signal is generated by amplitude modulating a carrier signal having a frequency equal to a value between 40% and 50% of the sampling rate.

8. The method of claim 1 further comprising:

converting the composite signal into an analog composite signal.

9. The method of claim 1 wherein the spectral content of the power signal does not overlap the spectral content of the audio signal.

10. The method of claim 1 further comprising:

providing the composite signal to the headset device.

11. The method of claim 10 further comprising:

processing the composite signal to provide the audio signal and a power signal; and processing the power signal to provide DC power for the headset.

12. The method of claim 11 wherein the step of processing the composite signal includes:

filtering the composite signal to recover the power signal; and rectifying the power signal to produce a rectified power signal.

13. The method of claim 11 wherein the step of processing the composite signal includes:

filtering the composite signal to recover the audio signal; and providing the recovered audio signal to a speaker in the headset device.

14. A system for providing power to a headset from a terminal device coupled to the headset device with a cable, the system comprising:

an audio signal source configured to provide an audio signal having a time-varying amplitude;

a power signal source configured to provide a power signal by amplitude modulating a carrier signal with a modulation signal that is formed in a complementary fashion to the time-varying amplitude of the audio signal; and a summing circuit operatively coupled to the audio signal source and the power signal source and configured to output a composite signal having an amplitude limited to a maximum amplitude value.

15. The system of claim 14 wherein the power signal circuit is configured to form the modulation signal by subtracting, from a maximum amplitude value, an amplitude value that is reflective of the amplitude of the audio signal.

16. The system of claim 14 wherein the power signal circuit is configured to form the modulation signal by subtracting, from a maximum amplitude value, a value that is reflective the absolute value of the amplitude of the audio signal.

17. The system of claim 14 wherein the power signal circuit is configured to provide a carrier signal that is a bandwidth-limited periodic signal.

18. The system of claim 17 wherein the periodic signal is selected from the group consisting of a square wave signal, a pulse train signal, a triangle wave signal, and a sinusoidal signal.

19. The system of claim 14 wherein the power signal and audio signal are digital signals having a sampling rate, and the power signal is generated by amplitude modulating a carrier signal having a frequency equal to a value between 40% and 50% of the sampling rate.

20. The system of claim 14 further comprising a circuit for converting the composite signal into an analog composite signal.

21. A communication system comprising:

a terminal device; and a headset device coupled to the terminal device with a cable;

the terminal device including:

an audio signal source configured to provide an audio signal having a time-varying amplitude;

a power signal source configured to provide a power signal by amplitude modulating a carrier signal with a modulation signal that is formed in a complementary fashion to the time-varying amplitude of the audio signal; and a summing circuit operatively coupled to the audio signal source and the power signal source, the summing circuit configured to output a composite signal having an amplitude limited to a maximum amplitude value;

the terminal device being configured to provide the composite signal to the headset for playing the audio signal and powering the headset with the power signal.

22. The communication system of claim 21 wherein the power signal source is operable for forming the modulation signal by subtracting, from a maximum amplitude value, an amplitude value that is reflective of the amplitude of the audio signal.

23. The communication system of claim 21 wherein the power signal source is configured to form the modulation signal by subtracting, from a maximum amplitude value, a value that is reflective the absolute value of the amplitude of the audio signal.

24. The communication system of claim 21 wherein the power signal source is configured to provide a carrier signal that is a bandwidth-limited periodic signal.

25. The communication system of claim 24 wherein the periodic signal is selected from the group consisting of a square wave signal, a pulse train signal, a triangle wave signal, and a sinusoidal signal.

26. The communication system of claim 21 wherein the power signal and audio signal are digital signals having a sampling rate, and the power signal is generated by amplitude modulating a carrier signal having a frequency equal to a value between 40% and 50% of the sampling rate.

27. The communication system of claim 21 wherein the terminal device further includes a circuit for converting the composite signal into an analog composite signal for providing the composite signal to the headset.

28. The communication system of claim 21, the headset device further including circuitry configured to process the composite signal to provide the audio signal and a power signal, the power signal having a DC component to provide power for the headset.

29. The communication system of claim 28 wherein the headset circuitry is further configured to process the composite signal by filtering the composite signal to recover the power signal, and rectifying the power signal to produce a rectified power signal.

30. The communication system of claim 28 wherein the headset device includes at least one earphone, and the headset circuitry is further configured to process the composite signal by filtering the composite signal to recover the audio signal, and to provide the recovered audio signal to the earphone.

* * * * *